US005299280A

United States Patent [19]

Ruark

[11] Patent Number: 5,299,280

[45] Date of Patent: Mar. 29, 1994

[54] WIPE ENTRY ARRANGEMENT FOR COMPONENTS IN A PROTECTIVE DAM AREA OF A FOAM INSULATED ELECTRIC WATER HEATER TANK

[75] Inventor: Darryl L. Ruark, Lugoff, S.C.

[73] Assignee: AOS Holding Company, Milwaukee, Wis.

[21] Appl. No.: 963,781

[22] Filed: Oct. 20, 1992

[51] Int. Cl.[5] ..... H05B 1/02; F24H 1/20; F24H 9/00; F22B 37/36

[52] U.S. Cl. ..... 392/449; 122/13.1; 122/494; 126/361; 126/374; 220/444; 220/902; 392/451

[58] Field of Search ..... 392/449, 451, 452; 122/494, 13.1; 126/361, 374; 220/444, 902

[56] References Cited

U.S. PATENT DOCUMENTS

| | | | |
|---|---|---|---|
| 3,253,731 | 5/1966 | Fink et al. . | |
| 3,626,151 | 12/1971 | Them | 392/449 |
| 5,005,531 | 4/1991 | Nelson | 126/361 X |
| 5,052,346 | 10/1991 | Beck | 392/449 X |
| 5,163,119 | 11/1992 | Windom | 392/449 |

FOREIGN PATENT DOCUMENTS

| | | | |
|---|---|---|---|
| 1368038 | 9/1974 | United Kingdom | 392/449 |

*Primary Examiner*—Anthony Bartis

*Attorney, Agent, or Firm*—David R. Price; James Earl Lowe, Jr.

[57] ABSTRACT

An electric water heater tank defines a water chamber having an electrical component extending outwardly of the outer surface of the tank. A spaced outer jacket surrounds the tank and has a opening affording access to the component. A protective dam in the opening bridges the gap between the tank and jacket in surrounding relationship to the component and is covered by a cap extending over the component and engaging the dam. Electrical wires connected to the component extend outwardly of the jacket between the cap and dam. A door covers the cap and dam and is secured to the jacket such that the door engages the cap to force the dam into sealing engagement with the jacket and tank. Foam thermal insulation material fills the space between the jacket and the outer surface of the tank.

11 Claims, 2 Drawing Sheets

WIPE ENTRY ARRANGEMENT FOR COMPONENTS IN A PROTECTIVE DAM AREA OF A FOAM INSULATED ELECTRIC WATER HEATER TANK

BACKGROUND OF THE INVENTION

The invention relates to water heaters, and more particularly to water heaters having foam insulation injected between the tank and the outer jacket. Still more particularly, the invention relates to arrangements for preventing such foam from reaching the electrical components between the tank and the outer jacket.

In order to protect the electrical components from the foam, it is known to provide a fiberglass dam surrounding the electrical components and extending between the tank and the outer jacket. The fiberglass is compressed between the inner surface of the outer jacket and the outer surface of the tank. See, for example, U.S. Pat. No. 4,744,488.

U.S. Ser. No. 734,707, which was Jul. 23, 1991, issued as U.S. Pat. No. 5,163,119 on Nov. 10, 1 and which is assigned to the assignee hereof, discloses a dam for protecting the electrical components of a water heater from foam during injection of the foam between the tank and the outer jacket of the water heater.

SUMMARY OF THE INVENTION

The invention provides an improved dam for protecting the electrical components of a water heater from foam during injection of the foam between the tank and the outer jacket of the water heater. The invention also provides an arrangement for allowing electrical wires to enter the dam.

More particularly, the invention provides a water heater comprising a tank defining a water chamber, with conventional electrical components, such as thermostats or heating elements, extending outwardly of the outer surface of the tank. The water heater also comprises an outer jacket surrounding the tank and having therein an opening affording access to the electrical components. As described more fully below, insulating foam is injected between the tank and the outer jacket.

The improved dam has a shape conforming to the shape of the opening in the outer jacket, and the dam is located in the opening and surrounds the electrical components. The dam includes an inner portion which is made of flexible urethane and which sealingly engages the outer surface of the tank. The dam also includes an outer portion made of expandable polystyrene. The outer portion includes an outwardly extending lip overlapping the outer surface of the outer jacket around the opening therein. The outer portion of the dam also includes an inner surface surrounding the electrical components. The inner surface has thereon a shoulder.

The water heater further comprises an insulating cap that is mounted within the dam and that covers the electrical components within the dam. More particularly, the cap has an outer surface engaging the inner surface of the dam, and the cap has an inwardly facing surface engaging the shoulder of the dam. The cap includes a handle that facilitates insertion and removal of the cap relative to the dam. The cap rigidifies the dam while the foam is being injected between the tank and the outer jacket. A door is mounted on the outer jacket and covers the cap and the dam. The door is secured to the outer jacket such that the door engages the handle of the cap and forces the cap inwardly against the shoulder of the dam. Consequently, the cap forces the dam inwardly such that the lip of the dam sealingly engages the outer jacket, and such that the inner portion of the dam sealingly engages the outer surface of the tank.

Additional electrical components, such as fuses, a transformer or a thermostat control, are located on the outer surface of the jacket outside of the dam, and electrical wires extend between the dam and the cap to connect the components inside the dam and the components outside the dam. To facilitate passage of the wires between the dam and the cap, the dam includes a ramped surface padded with flexible urethane, the cap includes a complementary ramped surface, and the wires enter the dam between the ramped surfaces.

The water heater is assembled by arranging the tank, the electrical components, the outer jacket, the dam, the cap and the door as described above. The foam is then injected between the tank and the outer jacket. Because the dam sealingly engages both the tank and the outer jacket, the foam is substantially prevented from entering the space within the dam. The foam is thereby substantially prevented from reaching the electrical components inside the dam. The cap rigidifies the dam and resists the force exerted on the dam by the foam during injection of the foam.

Other features and advantages of the invention will become apparent to those skilled in the art upon review of the following detailed description, claims and drawings.

Figure 3:
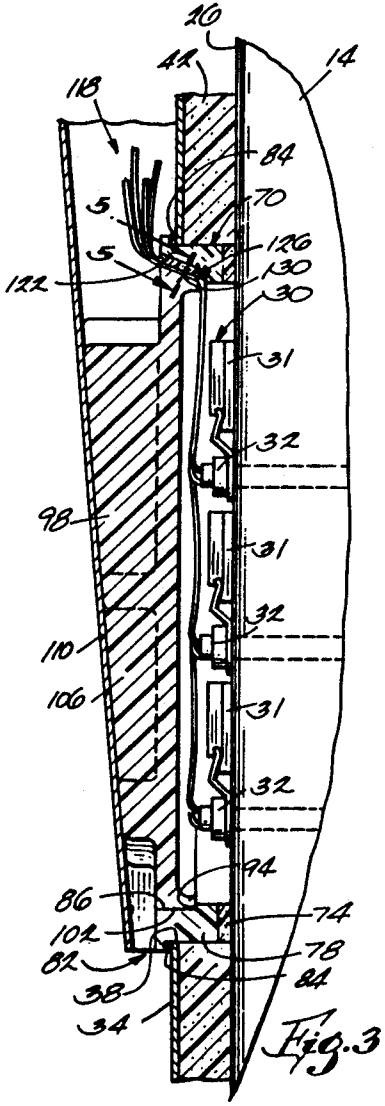
FIG. 3 is a view taken along line 3—3 in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A water heater 10 embodying the invention is illustrated in the drawings. The water heater 10 comprises (see FIG. 4) a tank 14 defining a water chamber 22. The tank 14 includes an outer surface 26. The water heater 10 also comprises (see FIG. 3) electrical components 30, such as thermostats 31 and heating elements 32, extending at least in part outwardly of the outer surface 26 of the tank 14.

Figure 4:
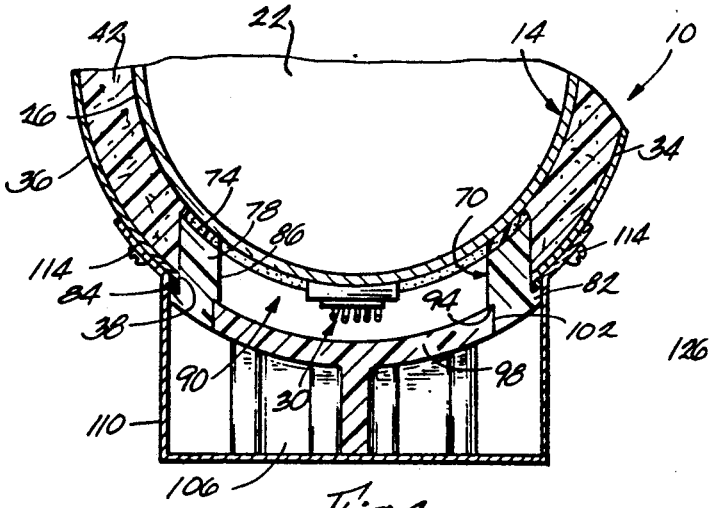
FIG. 4 is a view taken along line 4—4 in FIG. 2.

The water heater 10 further comprises an outer jacket 34 surrounding the tank 14, having an outer surface 36, and having therein an opening 38 affording access to the electrical components 30. In the illustrated construction, the opening 38 is rectangular. As shown in FIGS. 3 and 4, a layer of foam insulating material 42 is located between the tank 14 and the outer jacket 34. The manner in which the insulating material 42 is placed between the tank 14 and the outer jacket 34 is described below.

The water heater 10 further comprises (see FIGS. 2–4 and 6) a dam 70 which is located within the opening 38, which surrounds the electrical components 30, and which extends between the tank 14 and the outer jacket 34. The dam 70 is preferably rectangular, as shown in FIG. 2, so that the dam 70 fits snugly within the opening 38.

As shown in FIGS. 3 and 4, the dam 70 includes a flexible inner portion 74 sealingly engaging the outer surface 26 of the tank 14. The inner portion 74 is preferably made of flexible urethane. The dam 70 also includes an outer portion 78 fixed to the inner portion 74 by suitable means such as adhesive. The outer portion 78 includes, adjacent the outer end thereof, a lip 82 overlapping the outer surface 36 of the jacket 34. The inwardly facing portion of the lip 82 has thereon (see FIGS. 3, 4 and 6) a layer 84 of flexible material such as urethane sealingly engaging the outer surface 36 of the jacket 34. The outer portion 78 of the dam 70 also includes an inner surface 86 defining a space 90 containing the electrical components 30. As shown in FIGS. 2–4, the inner surface 86 has thereon a shoulder 94.

Figure 1:
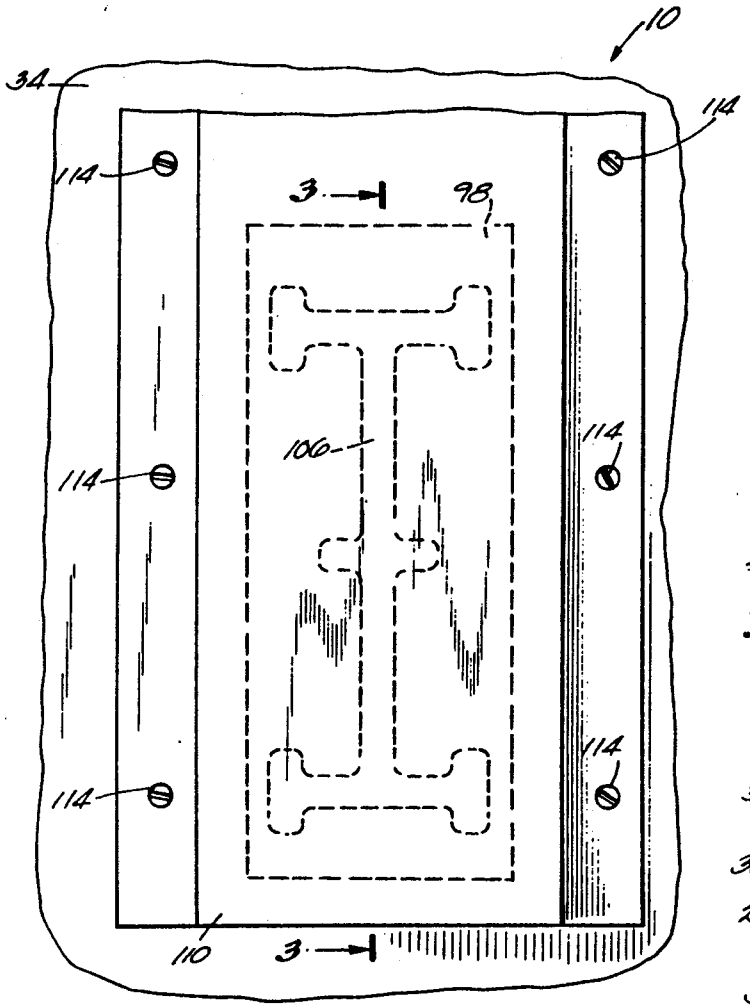
FIG. 1 is a partial elevational view of a water heater embodying the invention and including a dam, a cap and a door.

The water heater 10 further comprises (see FIGS. 2–4 and 6) an insulating cap 98 which is seated within the dam 70 and which extends over the electrical components 30. The cap 98 engages the shoulder 94 and includes an outer surface 102 engaging the inner surface 86 of the dam 70. The cap 98 also includes a handle 106 facilitating insertion of the cap 98 into the dam 70 and removal of the cap 98 from the dam 70. The water heater 10 further comprises (see FIGS. 1, 3, 4 and 6) a door 110 covering the cap 98 and the dam 70, and means for securing the door 110 to the jacket 34 such that the door engages the cap 98 and thereby forces the dam 70 toward the tank 34. This forces the lip 82 into sealing engagement with the outer surface 26 of the jacket 34 and also forces the inner portion of the dam 70 into sealing engagement with the outer surface 26 of the tank 14. Preferably, the door 110 is secured to the jacket 34 by screws 114 (FIGS. 1 and 4).

Figure 2:
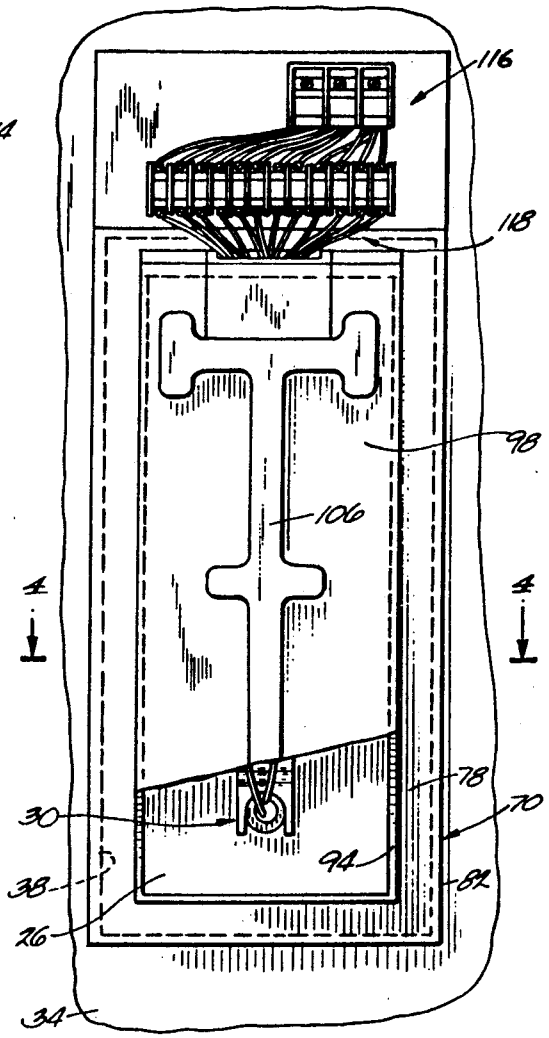
FIG. 2 is a view similar to FIG. 1 with the door removed.
Figure 5:
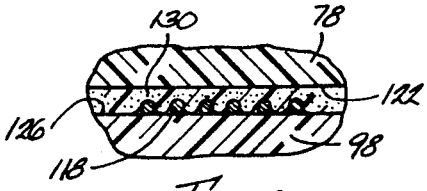
FIG. 5 is a view taken along line 5—5 in FIG. 3.
Figure 6:
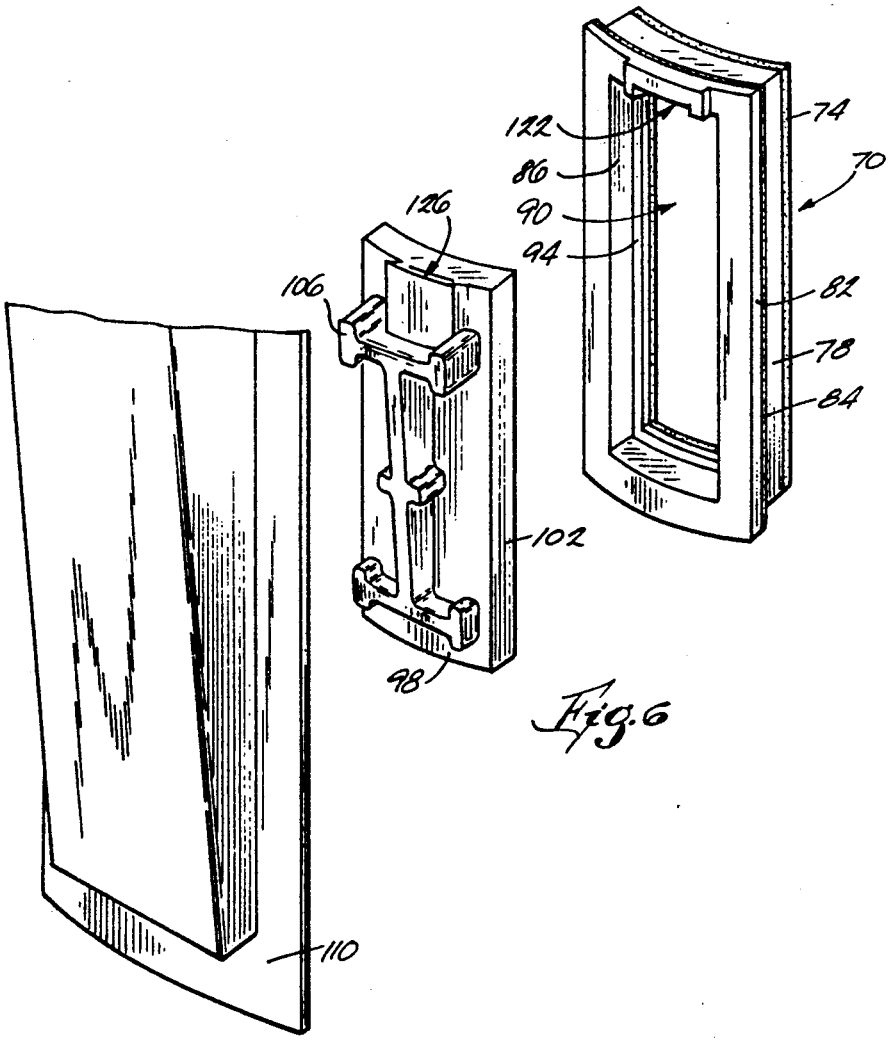
FIG. 6 is an exploded perspective view of the dam, the cap and the door.

As shown in FIG. 2, additional electrical components 116, such as fuses, a transformer and a thermostat control, are mounted on the outer surface 36 of the jacket 34 above the opening 38. The components 116 are connected to the components 30 by wires 118. As shown in FIG. 3, the wires 118 extend between the outer surface 102 of the cap 98 and the inner surface 86 of the dam 70, and means are provided between the cap 98 and the dam 70 for substantially preventing damage to the wires 118. Such means preferably includes (see FIGS. 3 and 5) a ramped portion 122 on the inner surface 86 of the dam 70 and a complementary a ramped portion 126 on the outer surface 102 of the cap 98. The ramped surface portion 122 of the dam extends outwardly from the shoulder 94 and is padded with a flexible material 130 such as flexible urethane. The ramped surfaces 122 and 126 and the flexible urethane 130 reduce the angles of the bends in the wires 118, and the flexible urethane also pads the wires.

The water heater 10 is assembled as follows. First, the tank 34, the electrical components 30, the outer jacket 34 and the dam 70 are arranged as described above. Next, the cap 98 is inserted into the dam 70, as described above, with the wires 118 entering the dam 70 between the ramped surfaces 122 and 126. Next, the door 46 is secured over the dam 70 and the cap 98 so that the door engages the cap 98 and thereby forces the dam 70 toward the tank 34. As a result, the lip 82 is pushed into sealing engagement with the outer surface 26 of the jacket 34 and the inner portion of the dam 70 is pushed into sealing engagement with the outer surface 26 of the tank 14. Last, foam 42 is injected between the tank 14 and the outer jacket 34 and around the dam 70 to provide insulation between the tank 14 and the outer jacket 34. Because the dam 70 sealingly engages both the tank 14 and the outer jacket 34, the dam 70 keeps substantially all of the foam 42 outside of the dam 70 and thereby substantially prevents the foam 42 from reaching the electrical components 30. The cap 98 rigidifies the dam 70 and helps the dam 70 to resist the force exerted on the dam 70 by the foam 42 during injection of the foam 42.

Various features of the invention are set forth in the following claims.

I claim:

1. A water heater comprising a tank defining a water chamber and including an outer surface, an electrical component extending outwardly of said outer surface of said tank, an outer jacket surrounding and spaced from said tank and having therein an opening affording access to said electrical component, a dam which is located within said opening, and which completely surrounds said electrical component, said dam bridging the space between said jacket and said tank, a cap extending over said electrical component and engaging said dam, electrical wires extending from said component, extending between said cap and said dam, and extending outwardly of the outer jacket, and insulating material located between said tank and said outer jacket and outside of said dam.

2. A water heater as set forth in claim 1 and further comprising means between said cap and said dam for substantially preventing damage to said wires.

3. A water heater as set forth in claim 1 wherein said dam includes an inner surface defining a space containing said electrical component, wherein said cap engages said inner surface of said dam, and wherein said wires extend between said cap and said inner surface of said dam.

4. A water heater as set forth in claim 3 wherein said inner surface of said dam includes a ramped portion, and wherein said wires extend between said cap and said ramped portion of said inner surface.

5. A water heater as set forth in claim 4 wherein said inner surface of said dam has thereon a shoulder, wherein said cap engages said shoulder, and wherein said ramped portion extends outwardly from said shoulder.

6. A water heater as set forth in claim 4 wherein said ramped portion is padded with a flexible material.

7. A water heater as set forth in claim 4 wherein said cap includes a ramped surface portion complementary with said ramped portion of said dam, and wherein said wires extend between said ramped portion of said cap and said ramped portion of said dam.

8. A water heater comprising a tank defining a water chamber and including an outer surface, an electrical component extending outwardly of said outer surface of said tank, an outer jacket having an outer surface and surrounding and spaced from said tank and having therein an opening affording access to said electrical component, a dam which is located within said opening, and which completely surrounds said electrical component, said dam bridging the space between said jacket and said tank, said dam including a lip overlapping said outer surface of said outer jacket, and an inner surface defining a space containing said electrical component, a cap extending over said electrical component and engaging said dam inner surface, a door covering said cap and said dam, said door acting through said cap to force said lip into sealing engagement with said outer surface of said jacket, means for securing said door to said jacket such that said door engages said cap and thereby forces said dam toward said tank and into sealing engagement with said outer surface of said tank, electrical wires extending from said component, extending between said cap and said inner surface of said dam, and extending outwardly of the outer jacket, and insulating material located between said tank and said outer jacket and outside of said dam.

9. A water heater as set forth in claim 8 wherein said inner surface of said dam includes a ramped portion, and wherein said wires extend between said cap and said ramped portion of said inner surface.

10. A water heater as set forth in claim 9 wherein said ramped portion is padded with a flexible material.

11. A water heater as set forth in claim 9 wherein said cap includes a ramped surface portion complementary with said ramped portion of said dam, and wherein said wires extend between said ramped portion of said cap and said ramped portion of said dam.

* * * * *